United States Patent [19]

Marchetti

[11] Patent Number: 4,543,150

[45] Date of Patent: Sep. 24, 1985

[54] TAPING MACHINE WITH CONVEYING UNITS AT ADJUSTABLE DISTANCE

[76] Inventor: Augusto Marchetti, Piazza Sicilia, 7, 20146 Milano, Italy

[21] Appl. No.: 582,233

[22] Filed: Feb. 21, 1984

[30] Foreign Application Priority Data

Feb. 24, 1983 [IT] Italy ..... 19734 A/83

[51] Int. Cl.[4] ..... B31B 1/00

[52] U.S. Cl. ..... 156/468; 53/157; 156/486; 198/627; 198/628

[58] Field of Search ..... 53/137, 374; 198/627, 198/628; 156/468, 475, 486

[56] References Cited

U.S. PATENT DOCUMENTS

| | | | |
|---|---|---|---|
| 1,743,018 | 1/1930 | Magnusson | 198/628 X |
| 2,332,672 | 10/1943 | Schmitt | 198/627 X |
| 3,179,269 | 4/1965 | Arnett | 198/628 X |
| 3,595,369 | 7/1971 | Boulay | 198/627 X |
| 3,598,227 | 8/1971 | Stanford | 198/627 |
| 4,161,138 | 7/1979 | Marchetti | 198/627 X |

*Primary Examiner*—David Simmons
*Attorney, Agent, or Firm*—Cushman, Darby & Cushman

[57] ABSTRACT

Two belt conveying units, which can be positioned at adjustable mutual distance, receive the belt driving movement by a transmission comprising conical gears slidingly mounted on a motorized shaft with polygonal cross-section situated at the outlet ends of said units. The above mentioned conical gears are provided with vertical outlet shafts, which simultaneously act as driving elements for the belts and as rotation pins for the support structures of the same belts.

A threaded shaft for spacial adjustment of the conveying units and a transversal guide system formed by sleeves of limited extension slidingly mounted on a single guide are situated in a same vertical plane at the inlet ends of the conveying units.

In addition to the motorization, the conveyor adjustment and the guide, there are thus assured limited rotary movements of the two units, which allow a suitable engagement of the belts with the carton sides for their whole path through the machine.

5 Claims, 4 Drawing Figures

TAPING MACHINE WITH CONVEYING UNITS AT ADJUSTABLE DISTANCE

The present invention relates to a taping machine with conveying units which can be positioned at adjustable distances from each other.

The term "taping machine" here means a machine able to apply adhesive sealing tapes along the bottom and the top of parallelogram cartons made to advance along a support base.

In the specific case of the present patent application reference is made, particularly, to a taping machine of the kind in which the carton advancement is caused by a pair of belt conveying units, which extend along the sides of the support base and can be positioned at adjustable mutual distance in order to realize the conveying engagement with opposite sides of cartons of different width.

It is clear that conveying units of such kind require a motorized control for the belt operation, guides for their transversal movement and a control for the distance adjustment.

In known taping machines of the above mentioned kind the motorized control is given through a chain and toothed gear transmission, which is positioned at the outlet end of the conveying units together with a pair of guide bars for the transversal movement of the same units, while the distance adjustment control is sometimes positioned at the inlet ends and sometimes at the outlet ends of the conveying units. In any case, at the inlet ends of the conveying unit there are associated elastic means able to give the same units a suitable work pressure against the carton sides.

The object of the present invention is to realize a taping machine of the above mentioned kind, which includes a motorization, guide and adjustment system for the conveying units, which is simpler than those presently used, above all as regards the motorization, but at the same time at least equally efficient.

In view of such object the taping machine according to the invention, comprising a carton support base and a pair of conveying units which extend along the sides of said support base and can be positioned at mutual adjustable distance, said conveying units being of the kind with movable conveying belts extending in support structures from inlet ends to outlet ends of said units and there being provided motorized means for driving said belts. Adjustment means for adjusting the mutual distance of said units and guide means for the adjustment transversal movement of said units, is characterized in that said motorized means includes a motorized shaft extending transversally to said support base at the outlet ends of said units. A pair of conical gears form a transmission slidingly mounted on said motorized shaft and coupled to it for the rotation. A pair of vertical shafts coming out from said transmission operate simultaneously as driving elements for said belts and as hinge pins for said support structures. The distance adjustment means includes a threaded shaft extending transversally to said support base at the inlet ends of said units and in screw engagement with nut-like members elastically connected to said support structures. The guide means includes a guide bar extending transversally to said support base substantially in the same vertical plane of said threaded shaft and a pair of sleeves of limited extension slidingly mounted on said guide bar and made integral with said support structures of the conveying units.

In other words, the taping machine according to the invention therefore includes a motorization system which is extremely simple and efficient, and which is disposed at the outlet ends of the conveying unit and to which there corresponds, at the inlet ends of the same units, an adjustment and guide system which allows spacial adjustment of the two conveying units at the most suitable mutual distance in relation to the width of the cartons to be sealed.

The most interesting feature however consists in that, due to the hinge connection between the conveying units and the conical gear transmission, in combination with the use of a guide bar situated in the same vertical plane of the adjustment threaded shaft (and therefore able to easily absorbe the elastic stresses created by the insertion of the carton front between the two conveying units) and of two cooperating sleeves of limited extension the two conveying units to make use of a certain flexibility of the same guide bar for their even minimum mutual inclination. During the work step there is allowed a certain mutual movement of the two units, which perfectly fits the same units to the progressive advancement movement of the cartons. More precisely, the introduction of a carton firstly causes the limited, elastically resisted opening of the inlet ends of the conveying units, while the outlet ends correspondingly rotate around their hinge pins, so that the two conveying units are in a slightly convergent position, which makes maximum the belt engagement with the initial part of the carton sides. At the end of the carton introduction, on the other hand, substantially the whole extension of the conveying units is affected by a separating stress which, due to the sliding assembly of the conical gear transmission on the motorized shaft, causes the disposition of the whole units in a spaced parallel condition. Finally, while the carton is going out, the conical gears remain in the previously assumed position, while the guide sleeves, not stressed outwards, slide on the relative bar in order to return in the initial position. Due to the hinge connection between the outlet ends of the conveying units and the conical gear transmission, the two conveying units dispose themselves in a slightly divergent position, which facilitate the expulsion of the carton. At the end of this latter, the two conveying units finally return in the approached parallel position.

In this way the cartons are interested in the most suitable way by the belts, beginning from the introduction step and then going on up to the expulsion step. On the other hand, the motorization control of the belts is unaltered during the whole operation, since the coupling between the motorized shaft and the conic groups is independent from the position of these latter.

The features of the present invention will be made more evident by the following detailed description of an embodiment illustrated by way of non-limitative example in the enclosed drawings, in which.

Figure 1:
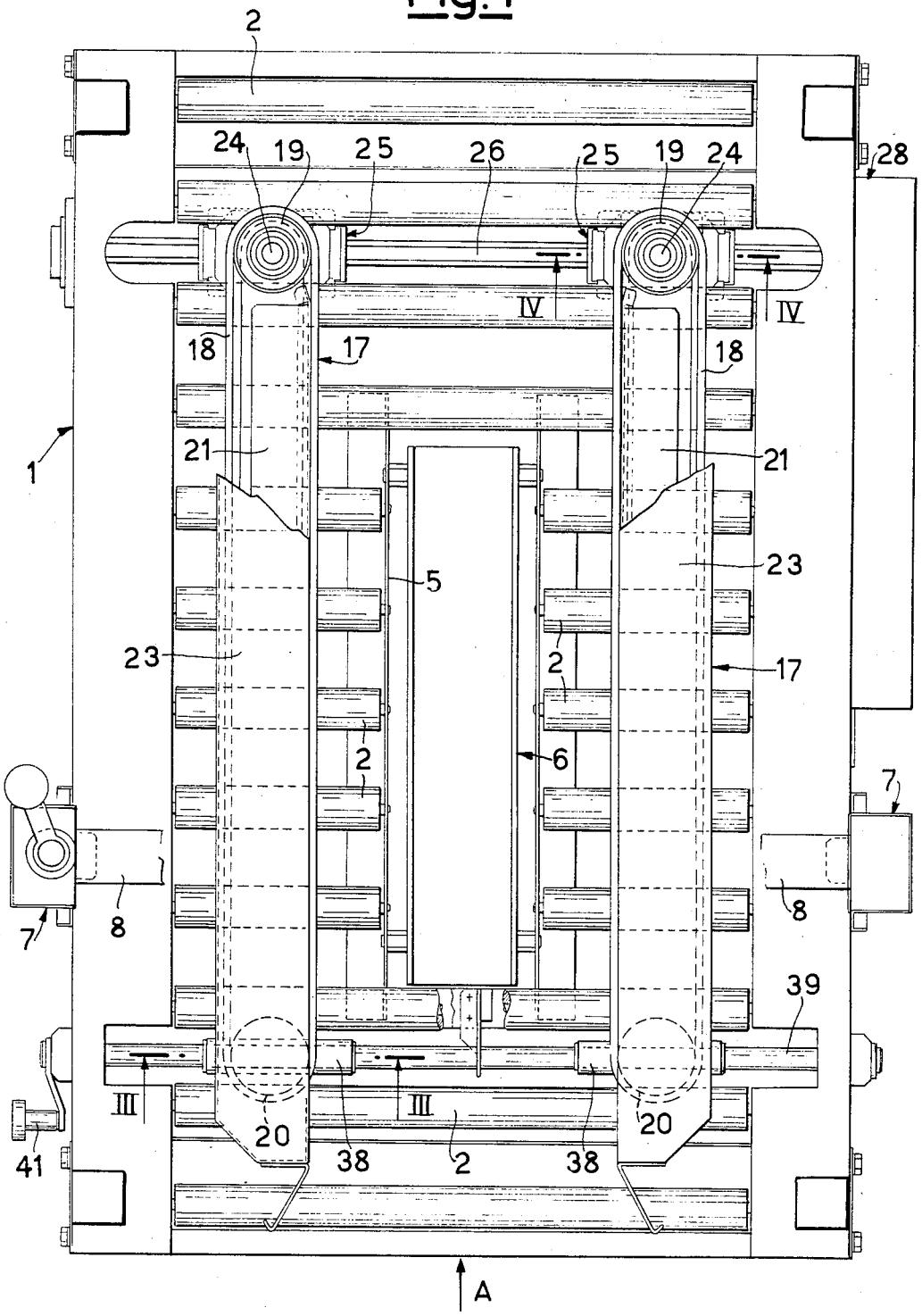
FIG. 1 shows a taping machine according to the invention in top plan, with the upper part removed for drawing convenience.
Figure 2:
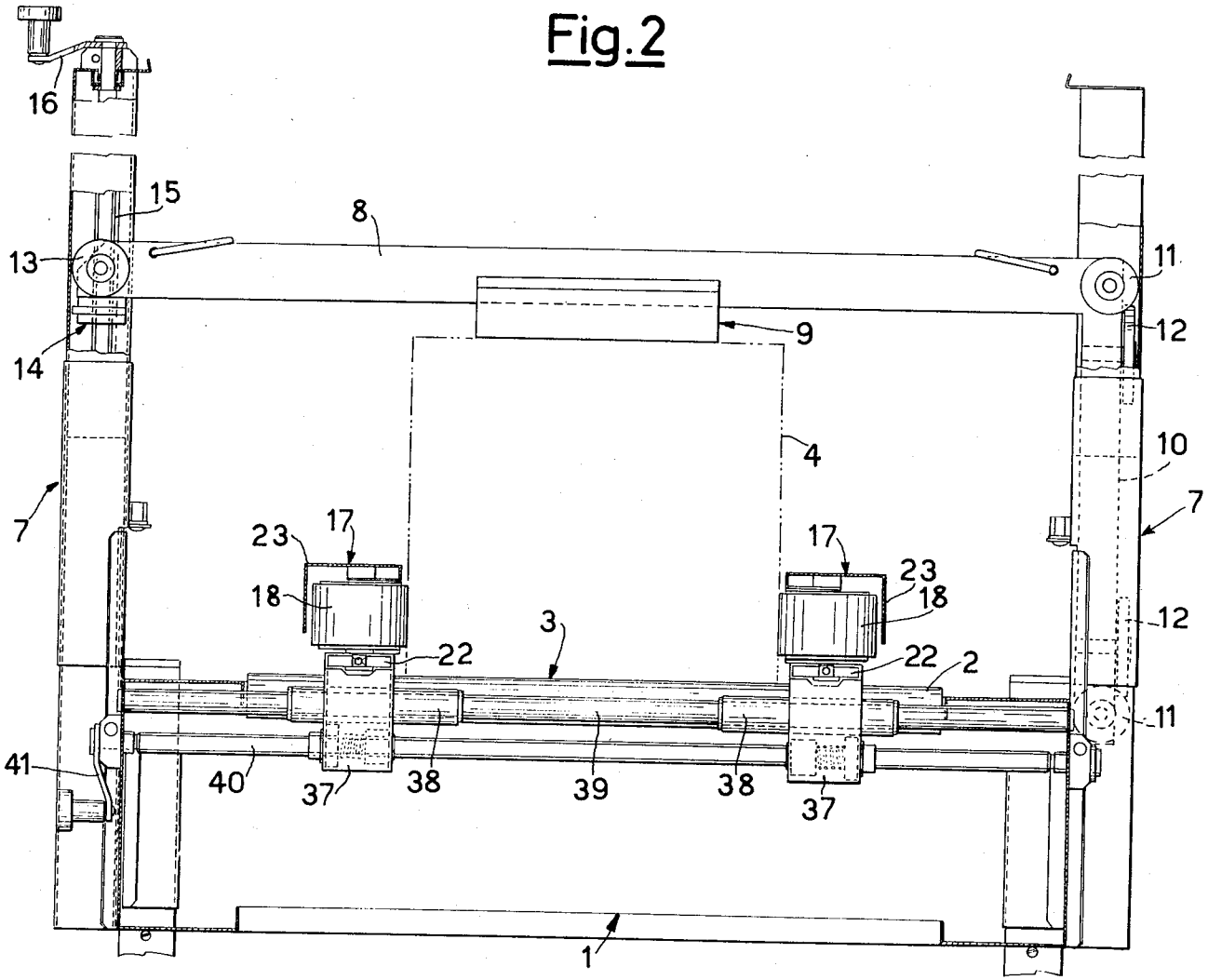
FIG. 2 shows said taping machine in elevation, seen according to arrow A of FIG. 1.

With reference to FIGS. 1 and 2, there is illustrated a taping machine, which comprises a support base 1 provided with a succesion of idle transversal rollers 2, parallel to each other, by which a support plane 3 for the cartons to be sealed is defined. One of these latter is schematically illustrated and generally indicated with the reference number 4 in FIG. 2.

At the center of the above mentioned roller succession there is defined a rectangular space 5 (FIG. 1), in which there is inserted and fixed a lower taping group 6 (not shown in detail for drawing simplicity), which has the function to apply an adhesive sealing tape along the slot usually arranged along the carton bottom.

From the two sides of the base 1 there extends upwards two box-like columns 7, which support at a variable width a horizontal cross-member 8 for the support of an upper taping group 9, which has the function to apply an adhesive sealing tape along the slot usually arranged along the top of the cartons. As shown in FIG. 2, from one end of the cross-member 8 there extends downwards and inside the relative box-like column 7 a vertical arm 10 slidingly coupled with the same column 7 by means of guide wheels 11 and 12 with perpendicular axes. The other end of the same cross-member 8 is slidingly engaged with the relative column 7 by means of guide wheels 13 and is also engaged through a screw nut 14 with a threaded vertical shaft 15 housed inside the column and provided upwardly with an operating crank 16. Through the rotation of this latter it is thus possible to adjust the position of the crossmember 8, and consequently of the upper taping group 9, according to the height of the cartons to be sealed.

For the advancement of the cartons on the support base 3 (in the direction of the arrow A of FIG. 1) there are provided two belt conveying units 17, which can be arranged at adjustable mutual distance for their engagement with the sides of cartons of variable width. As it can be seen from FIGS. 1, 3 and 4, each of the two conveying units 17 comprises a conveyor belt 18 stretched between a pair of end pulleys 19 and 20, the first one driving and the second one idle. The belts are also engaged in intermediate position with a guide and transversal retaining pad in antifriction material, as indicated with 21 in FIG. 1. The conveyor is coupled by a support structure formed by a lower plate 22 and by an upper carter 23, which also closes the outer side of the belt, leaving uncovered only that faced to the center of the support base 3.

Figure 4:
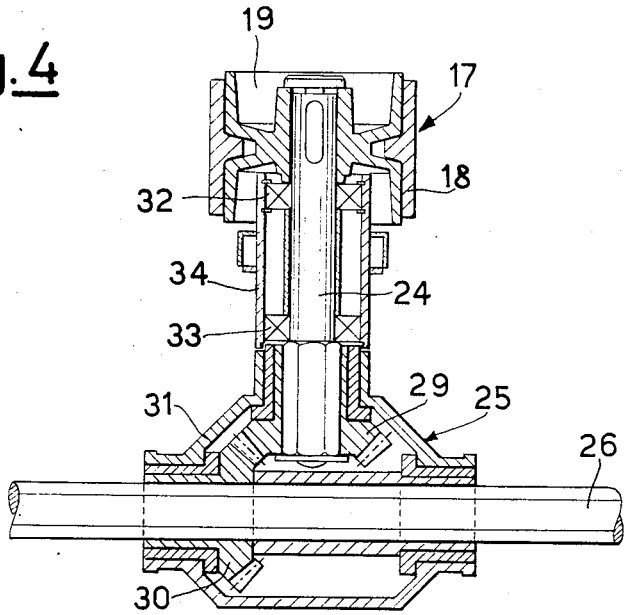
FIG. 4 shows the enlarged detail, in section according to line IV—IV of FIG. 1, of one of the conical gear transmission, which make part of the belt motorization system of the above mentioned machine.

As shown in FIG. 4, each of the two drive pulleys 19 is linked to a vertical shaft 24, which constitutes the outlet shaft of a conical gear transmission 25, which is slidingly mounted, and connected for the rotation, on a polygonal cross-section horizontal shaft 26, which transversally extends below the support base 3 at the outlet ends of the two conveying units 17 and is coupled to a suitable motor (not shown) by a chain or belt transmission 28. The above mentioned conical gear transmission 25 is substantially formed by two conical gears 29 and 30, the first one of which is connected for the rotation to the vertical shaft 24 and the second one of which is connected for the rotation, in axially sliding way, to the horizontal shaft 26, the whole being closed inside a protective cover 31. As also shown in FIG. 4, the vertical shaft 24 also functions as hinge pin, through bearings 32 and 33, for a sleeve 34 integral with the lower plate 22 and consequently, in general, to the support structure of the respective conveying unit 17.

Figure 3:
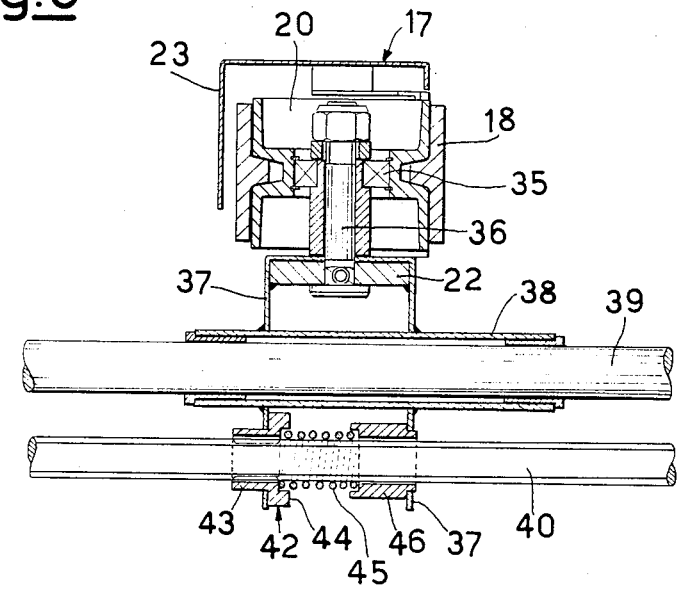
FIG. 3 shows the enlarged detail, in section along line III—III of FIG. 1, of one of the conveying units of the above mentioned machine and of the relative guide and adjustment system.

On the contrary, as shown in FIGS. 2 and 3, each of the two idle pulleys 20 is rotatably mounted, through a bearing 35, on a pin 36 rigidly fixed to the lower plate 22 and therefore, in general, to the protective structure of the respective conveying unit 17. To the plate 22 is also fixed a box-like support 37, which is fixed to a short cylindrical sleeve 38 slidingly mounted on a cylindrical guide bar 39, which transversally extends below the support base 3 at the inlet ends of the conveying units 17 (FIG. 1).

As also shown in FIGS. 2 and 3, below the guide bar 39, substantially in the same vertical plane, there is rotatably disposed a threaded shaft 40, whose rotation through a crank 41 allows adjustment of the distance between the two conveying units 17, fitting it to the different width of the cartons to be sealed. More precisely, the threaded shaft 40 is provided with two successive portions with opposite screw thread, with each engaged with a screw nut 42. This latter comprises a tubular portion 43, on which there is slidingly mounted a side of the above mentioned box-like support 37 of the conveying unit, and a flange portion 44, against which reacts a spring 45, which reacts at the opposite part against a sliding bushing 46, to which there is fixed the opposite side of the box-like support 37. This latter, and consequently the relative conveying unit 17, is however elastically stressed in the position of FIG. 3, corresponding to a position of mutual separation of the two conveying units with prefixed adjustment.

In the working, the distance adjustment for the two conveying units 17 is executed, as already said, by rotating the threaded shaft 40 by means of the crank 41; in such a way, the screw nuts 42 move away or approach each other (according to the rotation sense of the shaft 40) and the same is also made by the supports 37 and the conveying units 17, the movement being guided by the bar 39 at one end and by the polygonal shaft 26 at the other end. The adjustment is effected so that the distance between the belts 18 is just smaller than the width provided for the cartons to be sealed.

Once effected the distance adjustment, and also executed through the crank 16 the height adjustment of the upper taping group 9, a carton to be sealed (4) can be introduced in the machine in the direction indicated by the arrow A of FIG. 1.

The introduction of the frontal part of the carton between the two conveying units 17 gives these latter a force of separation of the inlet ends, which substantially acts in the same direction of the springs 45 and, due to the coplanar sliding connection between the sleeves 38 and the bar 39 and to the hinge connections between the conveying units 17 and the transmission 25, causes the rotation of the units 17 around the pins 24 for the disposition of the same units in slightly convergent position. This improves the engagement between the belts 18 and the carton sides and consequently facilitates the carton introduction.

When the carton is completely inserted between the two conveying units, on the other hand, the transmissions 25 also are interested by a removal thrust, which makes them slide on the motorized shaft 26 and consequently allows the conveying units 17 to reach the condition of perfect parallelism. This allows a correct conveying of the carton during the taping step.

In such removed position the two conic groups 25 remain also in the expulsion step of the carton, when the springs 45, with the aid of the short sliding guides 38, 39 and of the hinge pins 24, cause the approaching of the inlet ends of the two units 17 and consequently the disposition of the same units in slightly divergent condition. This helps the expulsion of the carton.

Finally, when the carton has been thrown out, the resistance offered by the carton being lacking, the two conic groups 25 are forced to approach in order to return the two conveying units 17 in the initial position illustrated in FIGS. 1, 2 and 3 (units 17 parallel and in position of minimum distance according to the effected adjustment).

I claim:

1. An apparatus for conveying articles comprising a horizontal support base, a pair of vertical conveyor belts disposed in a transversely displaceable manner at two sides of the support surface to engage sidewalls of the articles, the conveyor belts having a drive means comprising a drive shaft disposed transversally to the support base at the discharge end of the conveyor belts, the drive shaft having a polygonal cross-section supporting a pair of transmissions, one for each conveyor belt, the transmissions comprising a first conical gear slideably arranged on the drive shaft, a second conical gear meshing with and positioned perpendicular to the first conical gears, the second conical gear having a vertical shaft with a drive roller to receive and drive the conveyor belts, the apparatus further comprising a means to transversely displace the conveyor belts according to the size of the article being conveyed comprising a threaded shaft and a guide bar disposed transversally to the support base at the inlet end of the conveyor belts, a pair of support members supporting a vertical shaft and an idle roller to receive the conveyor belts, the support members being slideably mounted on the guide bar, the support members further having a threaded nut engaged with the threaded shaft, the threaded shaft having two portions with opposite threads each receiving one of the threaded nuts whereby rotation of the threaded shaft transversally displaces the conveyor belts with respect to each other.

2. The apparatus according to claim 1 wherein the support members further comprise a guide bushing slideable on the threaded shaft spring biased with the threaded nut whereby the support members can slide along the threaded shaft against the spring tension.

3. An apparatus for conveying and taping cartons comprising a horizontal support base, at least one taping means a pair of vertical conveyor belts disposed in a transversely displaceable manner at two sides of the support surface to engage sidewalls of the cartons, the conveyor belts having a drive means comprising a drive shaft disposed transversally to the support base at the discharge end of the conveyor belts, the drive shaft having a polygonal cross-section supporting a pair of transmissions, one for each conveyor belt, the transmissions comprising a first conical gear slideably arranged on the drive shaft, a second conical gear meshing with and positioned perpendicular to the first conical gear, the second conical gear having a first vertical shaft with a drive roller to receive and drive the conveyor belts, the apparatus further comprising a means to transversely displace the conveyor belts according to the width of the cartons comprising a threaded shaft and a guide bar disposed transversally to the support base at the inlet end of the conveyor belts, a pair of support members supporting a second vertical shaft and an idle roller to receive the conveyor belts, the support members being slideably mounted on the guide bar, a pair of brace members, the first brace member slideably receiving a threaded nut engaged with the threaded shaft, the second brace member having a bushing slideable on the threaded shaft, a spring between the bushing and the nut urging the nut against the first brace member whereby the support member is capable of limited sliding against the spring, the threaded shaft having two portions with opposite threads each portion receiving one of the threaded nuts whereby rotation of the threaded shaft transversally displaces the conveyor belts with respect to each other.

4. An apparatus as in claim 3 wherein the taping means is positioned between the conveyor belts to apply tape to the underside of the cartons.

5. An apparatus as in claim 3 wherein the taping means is positioned above and between the conveyor belts to apply tape to the top of the cartons.

* * * * *